US005297375A

United States Patent [19]

Reil et al.

[11] Patent Number: 5,297,375

[45] Date of Patent: Mar. 29, 1994

[54] METHOD AND APPARATUS FOR CLOSING A PACK

[75] Inventors: Wilhelm Reil, Bensheim; Manfred Wallich, Nauheim, both of Fed. Rep. of Germany

[73] Assignee: Tetra Laval Holdings & Finance S.A., Pully, Switzerland

[21] Appl. No.: 864,549

[22] Filed: Apr. 7, 1992

[30] Foreign Application Priority Data

Apr. 11, 1991 [DE] Fed. Rep. of Germany ..... 4111758

[51] Int. Cl.[5] ..... B65B 7/28

[52] U.S. Cl. ..... 53/420; 53/133.2; 53/133.4; 53/319; 53/489; 156/69

[58] Field of Search ..... 53/133.1, 133.2, 133.3, 53/133.4, 141, 290, 307, 329.3, 410, 412, 420, 489, 296, 319, 328, 373.3, 377.4; 156/69

[56] References Cited

U.S. PATENT DOCUMENTS

| | | | |
|---|---|---|---|
| 2,296,079 | 9/1942 | Anderson . | |
| 2,419,951 | 5/1947 | Kastel . | |
| 2,972,184 | 2/1961 | Andrew | 53/133.2 X |
| 3,029,570 | 4/1962 | Strakosch, Jr. et al. . | |
| 3,054,240 | 9/1962 | Dimond | 53/328 |
| 3,422,597 | 1/1969 | Beer | 53/307 |
| 3,434,908 | 3/1969 | MacDonald . | |
| 3,884,382 | 5/1975 | Ball | 53/489 X |
| 4,274,456 | 6/1981 | Huffman | 53/290 X |
| 4,397,401 | 8/1983 | Ueno et al. | 53/412 X |
| 4,585,498 | 4/1986 | Lagerstedt et al. | 156/69 |
| 4,592,690 | 6/1986 | Busch | 156/69 X |
| 4,696,143 | 9/1987 | Young | 53/307 X |
| 4,782,646 | 11/1988 | Nantin | 53/412 X |
| 4,817,363 | 4/1989 | St. Clair | 53/307 |
| 4,990,200 | 2/1991 | Heinz | 156/69 |

FOREIGN PATENT DOCUMENTS

| | | | |
|---|---|---|---|
| 963214 | 2/1975 | Canada | 156/69 |
| 3528815 | 2/1987 | Fed. Rep. of Germany . | |

*Primary Examiner*—John Sipos
*Assistant Examiner*—Daniel B. Moon
*Attorney, Agent, or Firm*—Burns, Doane, Swecker & Mathis

[57] ABSTRACT

A method and apparatus for sealingly closing a pack for liquids in which the top of the pack is provided with a hole into which is fitted a pouring device that includes a cup-like recess which defines a flange. The apparatus includes a pivot device that pivots about a main horizontal axis. The pivot device includes several mandrels onto which the pouring devices are to be individually mounted. The mandrels are rotatable about their respective longitudinal axes to allow a thread of adhesive to be applied to the flange of each pouring device so that the pouring device can be subsequently attached to the top of the pack by joining the flange of the pouring device to the collar of the hole in the pack.

21 Claims, 5 Drawing Sheets

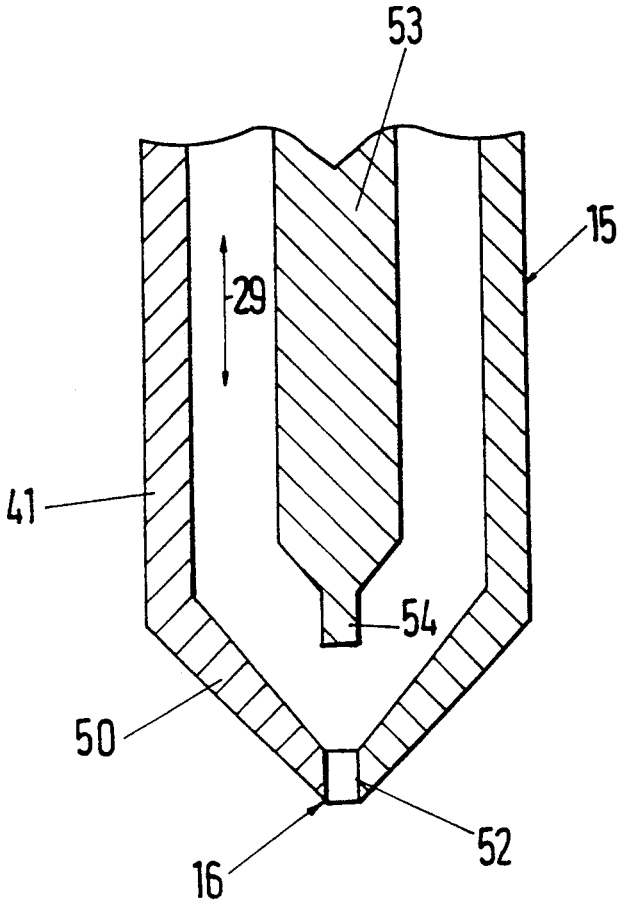
Fig.2
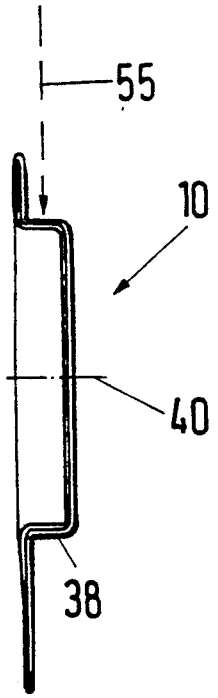

METHOD AND APPARATUS FOR CLOSING A PACK

FIELD OF THE INVENTION

The invention relates to a method for sealingly closing a pack for liquids.

BACKGROUND OF THE INVENTION

Many different shapes of packs and many different materials are known for making packs for packing liquids. Manufacturers are constantly seeking to make better packs more cheaply and preferably also so that they are environmentally-friendly. The packs are intended to be closed sealingly with a pouring device. While nonetheless presenting no significant problems to the end user when the packs are opened and the contents poured out. The very many kinds of packs include those which have a hole in the top which is closed by means of a pouring device which can be opened. While packs which are made of plastic-coated paper are known for keeping and transporting liquids, the present invention is concerned, in particular, with liquid packs made of plastic material wherein the hole in the top of the pack is surrounded by a collar which is like a partially cylindrical casing in shape and which has a central axis which is to be imagined as being disposed approximately vertically, but which can also be disposed at a certain angle to the perpendicular in special kinds of packs. The axis is taken as being a vertical central axis in the description of the present invention. The invention also relates to a pouring device, at least one part of which has a cup-shaped recess with a flange, with, on the outside, at least one wall which is like a partially cylindrical casing comparable to the afore-mentioned collar and of comparable diameter, so that the flange of the pouring device can be inserted into the collar of the hole. Liquids containers with lids which are closed in this way are known in the form of tin cans. However, the lid there is only capable of being opened if it is removed from the collar of the hole or from the tubular can, since cans of this kind do not have any special kind of top. However, seal-tight closure and also a good opening capacity are more problematic with pouring devices for liquids packs which have a top where only part of the upper surface is in the form of a hole. Pushing the flange of the pouring device into the collar of the hole is clearly only adequate for the purpose of sealing it from dust, but in order to close a pack for liquids so that it is seal-tight it is not enough by itself, not even if radial deformations are made to the flange and collar to provide undercut regions, snap-closure means, retaining means, or the like.

Those skilled in the art know that closure means have to be provided for liquids packs which are liquid-tight and even gas-tight.

Plastic containers are, admittedly, already known for packing, storing and transporting liquids. However, the manufacturing process and closure operation have hitherto always been somewhat tedious, and the present invention aims to overcome this. In the case of packs or pouring devices coated with plastic material, or with packs made of plastic material alone without any backing material, it is conceivable to join the pouring device to the pack using welding or sealing methods. However, this generally gives rise to problems. For example, in order to seal one plastic material to another, that is to say to sealingly join the flange of the pouring device to the collar of the hole in the pack, a temperature of 180° C. is required in order to obtain a pack which is reliable and usable. Sealing premanufactured pouring devices to the holes of separate packs is a difficult undertaking when such a temperature is required, and for this reason pack manufacturers have already gone over to forming the pouring devices integrally with the top of the pack, or to manufacturing them by injection moulding techniques. Another problem when sealing jaws are used to join the afore-mentioned parts is the fact that the sealing surfaces have to be heated from the outside through the layers of material, wherein care must at the same time be taken to ensure that the press-on operation is good and correct in shape. Those methods have not brought the desired success because a number of problems have made the manufacturer recognize that the material strength of the plastics parts to be joined is often not exactly the same, and even if they only differ slightly in respect of material strength, gaps occur which cannot be closed by sealing.

Packs are conceivable which are composed of two parts, such that after the pack has been manufactured the joined seam extends transversely through the top and even through the hole in the top, so that a mismatch occurs in the region of the seam during the welding operation. That results in gaps which would have to be sufficiently filled with weld material and closed when the flange of the pouring device is inserted. Insurmountable problems arose here, particularly when a plurality of packs was to be closed simultaneously, in mass production, using the afore-mentioned pouring devices. One single pouring device has to be arranged on one single hole with great precision, and this cannot be done without effort. This method of closing packs is obviously more problematical with mass production, when, for example, five, ten or more packs are to be closed simultaneously, since it would appear that it is very difficult to place the pouring device in the holes accurately and then at the same time to seal it in place.

OBJECT AND SUMMARY OF THE INVENTION

The aim of the invention is therefore to create a method and apparatus for closing a pack for liquids wherein it is possible for the flange of a pouring device to be reliably and accurately placed sealingly in the collar of a hole, and wherein the problems which were to be feared hitherto are excluded, even in the case of mass production.

According to the invention, as far as the method is concerned, this problem is solved in that the separate pouring device is placed on a support and is rotated therewith about a longitudinal axis, while a thread of adhesive is placed on the flange of the pouring device when the support is rotated about the longitudinal axis, and the flange of the pouring device is brought into contact, and joined, to the collar of the hole.

The thread of adhesive must be compatible with the contents of the pack. This is of particular importance when foods are the packaged item, and it must be understood that the adhesive which is used according to the invention is compatible with foods. There will now follow some examples, wherein a wide selection of substances which are compatible with foods is available.

That which is special and new with the method according to the invention is the fact that the thread of adhesive is placed on the flange of the pouring device, while this pouring device—mounted on a support—is rotated, whereupon the pack and pouring device are brought together and joined to each other. It has been shown that despite the difference in thickness between the materials, no problems arise with the process for manufacturing these packs when the flange of the pouring device is inserted into the collar of the hole, and any tolerances are compensated for by the thread of adhesive that is applied. This makes it possible for a number of packs to be closed simultaneously because the pouring devices can be placed over the holes of the packs properly and accurately.

It is true that a method is known per se whereby plastic parts are joined or stuck by the application of hot melt, but the injection nozzles which are used for this purpose are only suitable for use with the method and apparatus in question here if certain conditions are satisfied. Thus, with an advantageous embodiment of the invention it is expedient if the thread of adhesive is allowed to run out by the effects of gravity vertically from a nozzle onto the flange of the pouring device which rotates, preferably three times through 360°, about a horizontal longitudinal axis. With the previously known method, nozzles were used for applying hot melt to an adhesion location, these nozzles operating at high pressures and with injected masses. Surprisingly, it has been shown according to the invention that a thread of adhesive which runs around the flange of the pouring device can be applied particularly advantageously in the above-mentioned way if it is aided by the effects of gravity. According to the invention, the nozzle operates at significantly lower pressures, so that the thread of adhesive requires the force of gravity and consequently runs out of the outlet opening of the nozzle in a substantially perpendicular (vertical) direction. As this happens, the flange of the pouring device rotates through at least 360° about an axis which is disposed vertically to the direction in which the thread of adhesive runs out, so that the entire periphery of the flange is provided with the thread of adhesive. In order to avoid gaps, regions of overlap, regions of increased thickness and the like, it is particularly advantageous, if, when the thread of adhesive runs out, the flange is completely rotated three times about its axis, i.e. passes through an angle of 360° three times, if the start and end of the thread of adhesive is considered. In other words, the place where the thread of adhesive meets the flange of the pouring device appears four times during rotation, once before the beginning or start of the thread of adhesive and last of all at the end of the thread of adhesive.

It is expedient according to the invention therein if a hot melt thread is used as the thread of adhesive. Hot melt is a collective name taken from the English language for fusion adhesives and hot melt masses. The term, "hotmelt-adhesive" should correctly be used. The fusion adhesives which are denoted thus, and which are used according to the invention, are solid at room temperature, and are mostly free from water or solvents. They are applied in the form of melts to make adhesive, and they have the desired bonding effect when they solidify on cooling. The fusion adhesives are made from EVA, PA or PES, and also from EEA, PVB or PIB, very often together with natural- or synthetic resins and/or paraffins or microwax. The hot sealing adhesives can also be capable of becoming active on being heated. They are applied to the surface of the flange in the form of solutions, emulsions or dispersions, but also in the form of powders or melts, and according to the invention here in the form of an adhesive, and they bind on that surface, initially as a result of the solvent vaporising, or by the effects of cooling, to form a non-sticky adhesive. When the surfaces to be joined together are joined and pressed together, i.e. the flange of the pouring device and the collar of the hole, the adhesive can also be activated by being heated. On cooling, the adhesive then solidifies. The hot sealing adhesives used are often (co-) polymers based on ethylene, (meth)acrylates, vinyl chloride, vinylidene chloride and vinyl acetate and polyamide, polyester and polyurethane, amongst others.

The material for the collar of the hole in the top of the pack, i.e. also for the entire pack for liquids, is preferably a deep-drawable plastics material, e.g. a thermoplastic plastic material, e.g. polypropylene. PVC can also be used as one such plastic material, wherein polypropene is widely known as polypropylene in the art. The pack which is to be closed thus consists of parts which can be properly reworked and which are easily decomposable (unlike composite paper/plastic material). With one particularly preferable embodiment, the plastic material, i.e. the polypropene, can also be filled, wherein fillers can be chalks, mica, talc, gypsum or the like. In practice, filling degrees of up to 70%, preferably 60%, have proved favourable. It has been shown that these kinds of filled plastic materials are easily decomposable, on the one hand, without further ado, of course, and can be reworked or recycled using simple methods, and, on the other hand, do not adversely affect the properties of a plastic material, so that these kinds of filled plastic materials are, in particular, also deep-drawable and capable of being sealed.

Even the pouring device could be made from the above-described deep-drawable plastic materials, and those plastic materials can be stuck together properly in seal-tight manner using the afore-described hot melt.

The invention also relates to an apparatus for sealingly closing a pack for liquids, in the top of which pack there is a hole with an upstanding collar, wherein a pouring device which is provided with a cup-shaped recess with a flange is joined to the collar of the hole. The above-mentioned problem is solved according to the invention, as far as the apparatus is concerned, in that a pivot device which is driven so that it is capable of intermittent rotation about a horizontal main axis has at least two diametrically oppositely disposed mandrels which are each driven so that they are capable of rotation about their longitudinal axes, and that arranged at a vertical spacing (a) above the free end of the one mandrel which is horizontally disposed is the outlet opening of an adhesive device. An apparatus of this kind is particularly suited to carrying out the afore-described method. The principal component of the new machine is the rotatable pivot device, by means of which the two mandrels which may be arranged in a line behind one another, for example, can be rotated intermittently. These mandrels can actually each hold a separate pouring device, in such a way that the flange is clamped, placed or pushed over the outer end of the respective mandrel, and can be moved non-rotatably with the mandrel relative thereto. The respective mandrel with the flange of the pouring device placed thereon can thus be rotated, preferably through 90°, intermittently about the horizontal main axis. Once rotated 90° about the main axis, the mandrel can then be rotated about its own horizontally arranged longitudinal axis. Under these conditions, the flange will be able to rotate about the horizontal axis by way of the mandrel. While the thread of adhesive will pass out of the outlet opening of the adhesive device thereabove, and can be placed on the flange. If the flange is rotated after the start of the thread of adhesive has been applied, the thread will be placed on the flange at least once over the entire periphery, if the flange is rotated at least 360° through the longitudinal axis of the mandrel which is then disposed in the horizontal plane. After application of the thread of adhesive is complete, rotation of the mandrel about its own longitudinal axis is discontinued, so that the entire pivot device can again rotate through 90° in the next stage about the other horizontal main axis, and so that the flange of the pouring device can also rotate, by means of the mandrel, into the next position, where the pouring device, with the thread of adhesive applied to it, can be brought into engagement with the hole of the pack which is to be closed.

It has been shown to be particularly advantageous, if, according to the invention, the peripheral speed of the mandrel which rotates about the longitudinal axis is greater than the speed at which the thread of adhesive runs out. This means that the thread of adhesive running out is extended and stretched. This, in turn, permits the thread to be applied in a precise manner in a line to the flange of the pouring device. It has proved to be advantageous with one particular embodiment if the aforementioned vertical spacing between the uppermost surface, in the form of a cylindrical casing, of the mandrel and of the outlet opening the adhesive device disposed substantially vertically above the horizontally disposed mandrel is at least 25 mm. The plastic material used then only meets the start of the thread on the flange of the pouring device if the thread has passed at least 25 mm over it. This lends a certain initial rigidity to the thread which permits the thread of adhesive to be stretched and stuck to the surface of the flange of the pouring device. These dimensions have proved favourable at the end of the thread of adhesive since, after it has been cut off, the thread falls away further at about the speed at which it runs out, while, at the same time the horizontally disposed mandrel is rotated still further so that the hot melt is applied in a straight line to the flange. The length of the thread of adhesive and the circumferential rotation of the mandrel with the flange thereon are adapted to one another so that any likely abutment locations, regions of increased thickness or places where the adhesive is exposed are avoided on the flange of the pouring device.

It is also expedient according to the invention if a depressing mechanism which can be moved up and down vertically is arranged above the pivot device and above the free end face of the one mandrel which is disposed in the vertically upwardly projecting position, and if this depressing mechanism is provided with a cutting device. The depressing mechanism can grip a pouring device after or during the separating process, and it can press it onto the mandrel placed vertically therebeneath in such a way that the flange of the cup-shaped recess of the pouring device, i.e. of the cup with the opening comes to sit on the mandrel at the bottom. This seating is effected with sufficient clamping force to ensure that the pouring device moves with the mandrel when it moves. The vertical upward and downward movement of the depressing mechanism is synchronised with the intermittent rotation of the pivot device, and is preferably also simultaneously synchronised with the opening of the outlet nozzle of the adhesive device, so that with the correct operating stroke the separated pouring device is pushed into the operative region between the depressing mechanism and mandrel, and the depressing mechanism then presses the pouring device over the end face of the mandrel onto the free end thereof, whereupon the pivot device rotates intermittently through 90°, so that only then does the nozzle begin to apply the thread of adhesive.

It is also expedient according to the invention if the adhesive device has a nozzle body which tapers in the downward extent, which bears the outlet opening in the centre of the bottom, and which preferably is heatable, the nozzle body has a nozzle needle which can be moved up and down inside the nozzle body, and the nozzle needle has a cylindrical nozzle needle point so that the nozzle needle tip closes the outlet opening in the bottom-most position and completely blocks it. While injection nozzles hitherto have injected strands of plastics material at high pressure, and since the injection opening has hitherto been designed in such a way that a nozzle needle was designed so that its point was at the front in order to close the injection opening, the invention now provides that the nozzle operates with a very low internal pressure because the thread of adhesive only needs to flow out slightly and does not need to be injected. By virtue of the downwardly disposed outlet opening on the nozzle body, the force of gravity on the issuing thread of adhesive can be optimised. The nozzle needle which is movable up and down vertically inside the nozzle body has a tip at the front-most bottom end, which is designed in such a way that in the bottom-most position, thus when the tip of the nozzle needle is driven into the outlet opening, the cylindrical nozzle needle tip completely fills the outlet opening. In other words, the outlet opening is completely emptied after the thread of adhesive has run out. The outlet opening is thus completely clean, so that no blockage could form and cool anywhere in the outlet opening which would then run out at the bottom attached to the next thread when this latter is pushed out resulting in the start of the thread of adhesive being incorrectly placed on the flange of the pouring device. Advantageously, the cylindrical nozzle needle tip of the thread of adhesive is not only cut off with precision, but the needle tip terminates exactly with the outlet opening and in alignment therewith. After the outlet opening has been closed thus, the mandrel can rotate on additional amount about its horizontal longitudinal axis, so that the residual thread is drawn by the rotating flange and is neatly wrapped around the flange.

It is also expedient according to the invention if the pack with the vertically upwardly disposed hole which is to be closed can be arranged on a pack lifting mechanism which can be displaced vertically through an adequate stroke movement to bring the hole in the pack into operative engagement with the free end of the mandrel which is disposed in the vertically downwardly projecting position. One and the same pivot device can be used advantageously by virtue of the above-mentioned features for the purpose of joining the pouring device and hole in the pack. The pouring device is thus clamped onto the free end of the mandrel in such a way that sufficient frictional force is present to allow the pouring device to be rotated about the two afore-mentioned vertical axes, whereby the thread of adhesive can be placed accurately on the flange. This pouring device which is provided with the thread of adhesive is then brought into operative engagement with the collar of the hole, so that the pack which is supported on a support in the form of a pack lifting mechanism, is raised with a stroke movement which is directed vertically upwardly (and downwardly when it is being withdrawn), so that the flange of the pouring device is inserted into the collar of the hole of the pack. In the inserted condition, the thread of adhesive which is still able to be plastically deformed penetrates all gaps and seams, and, particularly in the case of two shell-like plastic packs or when the join seam extends through the top but is interrupted by the hole, penetrates into the gaps formed by the seam so that the pouring device is also effectively closed in liquid-tight manner, in the region of the top, when low-viscosity liquids are present.

After it has reached its uppermost position where the flange of the pouring device is arranged completely in the collar of the hole in the top, the vertically displaceable pack lifting mechanism reverses its operative direction and moves vertically downwardly. The adhesive effect of the thread of adhesive or of the thread of hot melt is still insufficient to remove the pouring device from the mandrel of the pivot device. Therefore, when the pack is moved down, an auxiliary fork assists in removing the pouring device from the mandrel of the pivot device, and so owing to the action of this auxiliary fork, the pack, together with the pouring device, then remains on the pack lifting mechanism and is moved back in the vertical downward direction therewith. The pouring device which was originally clamped onto the mandrel is thus stripped off the mandrel by the aid of the auxiliary fork when the pack provided with the pouring device is lowered by the pack lifting mechanism because the pouring device has been pushed into the hole in the top. The auxiliary fork is needed because the fusion adhesive is not yet of the required rigidity. The mandrel is then emptied or the pouring device removed, so that it can be advanced freely and is ready for the next tasks.

Therein, it is advantageously favourable, if, according to the invention, the drive control means for rotating the mandrel about the longitudinal axis is synchronised with the drive control means of the nozzle needle. This measure has already been mentioned above, and serves to place the thread of adhesive, with precision, on the cylindrical casing-like outside of the flange of the pouring device. By virtue of the synchronous control of the nozzle mechanism, the start of the thread of adhesive comes at exactly the right place on the outside of the flange of the pouring device, and is wrapped around the flange along the periphery from that place, so that after the thread of fusion melt has been cut off and when it is ready and applied, the entire upper surface of the flange is coated with the desired amount, and a sufficient amount, of the adhesive or melt adhesive or hot melt.

In mass production, the features according to the invention can be provided to reproduce the above-described operational processes in such a way that a plurality of pivot devices is arranged to rotate about a joint horizontal main axis, so that the corresponding number of adhesive devices and preferably also depressing mechanisms is provided, and so that the pack lifting mechanism is elongate in design for the purpose of receiving the corresponding number of packs. Pack manufacturing machines and closure machines are being planned with which a plurality of packs are manufactured in one piece, treated and then closed simultaneously. For example, thought has been given to setting up a row of ten packs at the same time, filling them and closing them. These ten packs would then be pushed onto the appropriate elongate pack lifting mechanism, and the appropriate number of pivot devices would be disposed opposite the vertically disposed mandrels. There is no problem at all in constructing the corresponding number of depressing mechanisms and the corresponding locally associated adhesive devices, since the depressing mechanisms can sit on one common axis which is easily rotatably driven by reliable machine elements.

If sterile contents are to be packaged, then it is possible, according to the invention, to provide for at least the pivot device, the adhesive device and the pack lifting mechanism to be accommodated in an aseptic chamber. The arrangement of a conveyor belt, a depressing mechanism, also provided with a cutting device, a pivot device, and even the pack lifting mechanism, within an aseptic chamber is easy. It would be a little more difficult to arrange the entire adhesive device inside the aseptic chamber. Here, it has been recognised, according to the invention, that the whole adhesive device does not need to be arranged within the chamber, but it is sufficient if only a part of the nozzle tip projects into the aseptic chamber, e.g. with the aid of a seal. The rear main part of the nozzle, the heating means and the other elements of the adhesive device would then remain outside the aseptic chamber.

The afore-mentioned measures make it possible for the afore-described apparatus to be used according to the invention for manufacturing a plastic pack provided with a closed pouring device which is capable of being opened. The pouring device is placed on the hole of a pack which is filled with liquid-even under aseptic conditions-with precision and in a way which is controlled temporally by the desired working stroke movement. The afore-described method and the special apparatus according to the invention can even be used to close five or more packs, preferably ten packs, simultaneously, so that all holes in the tops of the packs are reliably closed by the pouring devices in a fluid-tight manner.

BRIEF DESCRIPTION OF THE DRAWING FIGURES

Further advantages, features and possible applications of the present invention will result from the following description, given in conjunction with the drawings, wherein:

FIG. 1 is an illustration of devices arranged in an aseptic chamber, particularly the depressing mechanism, above, the pivot device therebeneath, and, in the lower half, the pack which is placed on the pack lifting mechanism.

FIG. 2 is a cross-sectional view, on an enlarged scale, of the nozzle of the adhesive device, with the pouring device arranged therebeneath, with the flange for placement of the adhesive, FIG. 3 shows a perspective view, on a larger scale, of a pack with a hole in the top, FIG. 4 shows a perspective view of a pouring device of one particular embodiment, FIG. 5 is a cross-sectional view of an embodiment, similar in design to that shown in FIG. 4, of a pouring device which sits in the collar of the hole and which is partially open, and FIG. 6 is an illustration of an alternative embodiment in which a plurality of pivot devices are positioned above a series of packs.

DETAILED DESCRIPTION OF THE PREFERRED EMBODIMENTS

Figure 3:
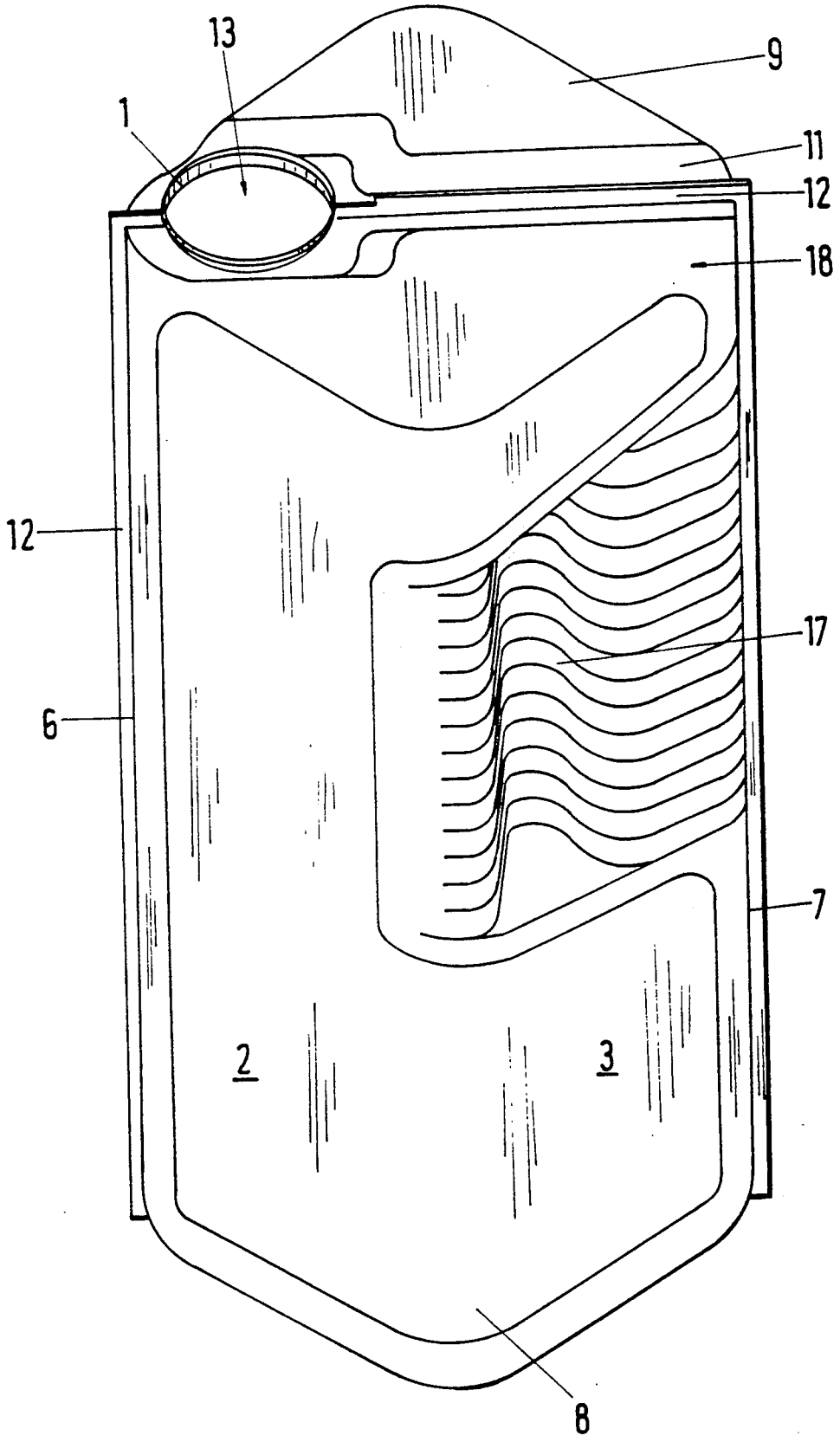
Figure 4:
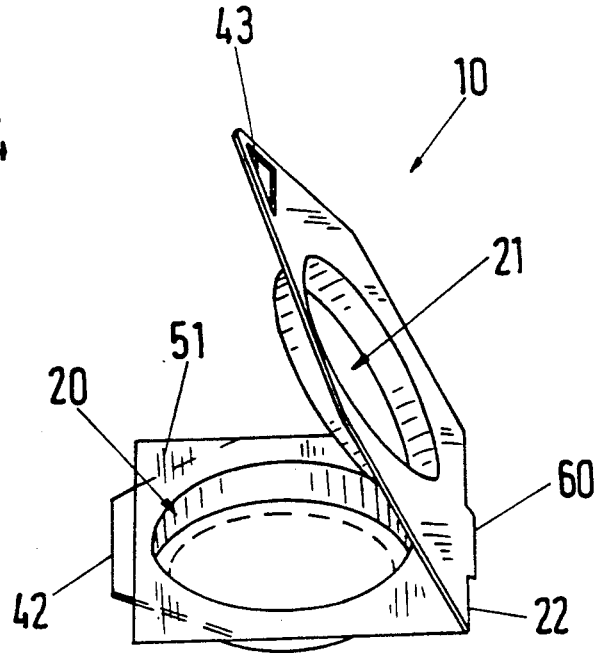
Figure 5:
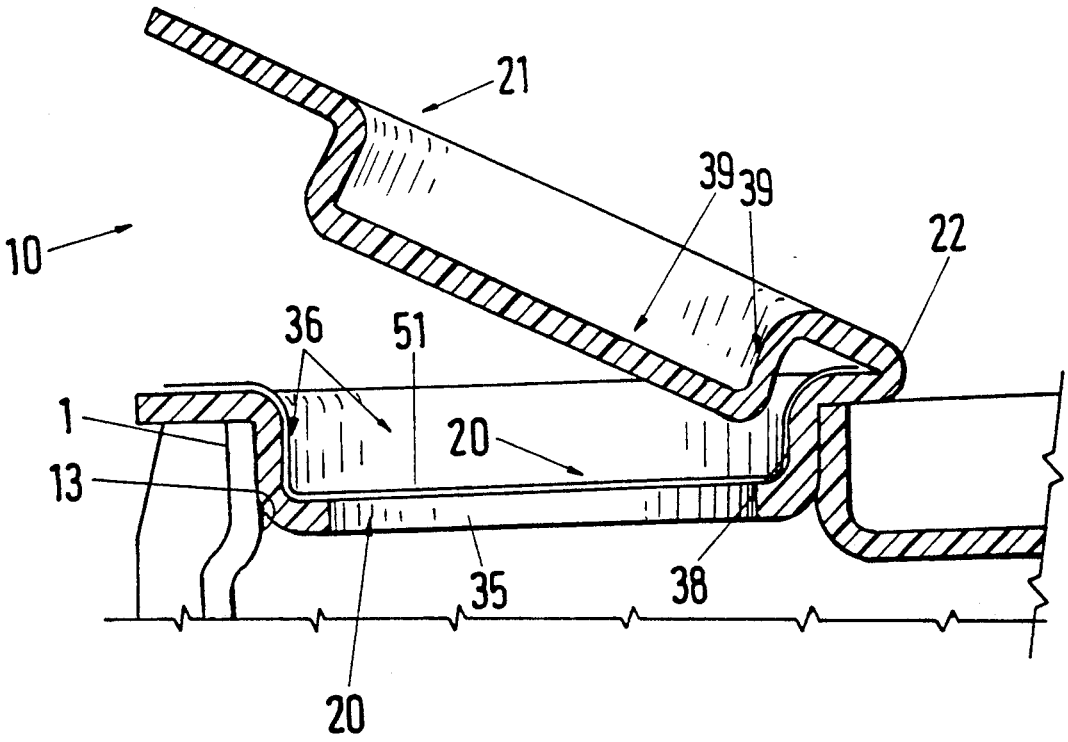

The pouring device which is generally denoted in the drawings by the reference numeral 10 consists of a bottom 20 and a closure part 21 which is pivotally joined to the bottom longitudinally by a hinge 22, the closure part 21 is provided with a locking limb 60 at the rear end, according to the embodiment shown in FIG. 4, and with a gripping means 43 in the form of a triangular hole at the front on the oppositely disposed side. Both the bottom part 20 and the closure part 21 each have a cup-shaped recess 36 or 39 which forms a flange 38 when the entire pouring device 10 is in the closed condition, and this flange can be inserted into the collar 1 of the hole 13 in the top 9 of a pack 18, and is inserted in accordance with the sectional drawing in FIG. 5. The particular pack 18 shown in the perspective illustration in FIG. 3 is basically quadrilateral in cross-section and forms an elongate tube shape with rounded longitudinal edges 6–8, between which substantially flat side walls, 2, 3, and the like, join the top 9 to the bottom beneath it, not shown. A gripping region 17 is provided to allow the pack to be easily gripped. A reinforcing rib 12 passes around the inside of a recess 11 which passes through the top 9 centrally and also the hole 13, this reinforcing rib at the same time providing a liquid-tight connection between the two halves of the shell of which the pack 18 is formed. Since the reinforcing rib 12 is interrupted by the hole 13, the collar 1 of the hole 13 can have slight spaces or gaps on diametrically oppositely disposed sides on the inner surface of same. As described above, those gaps or spaces have to be closed when the pouring device 10 is in use.

Figure 1:
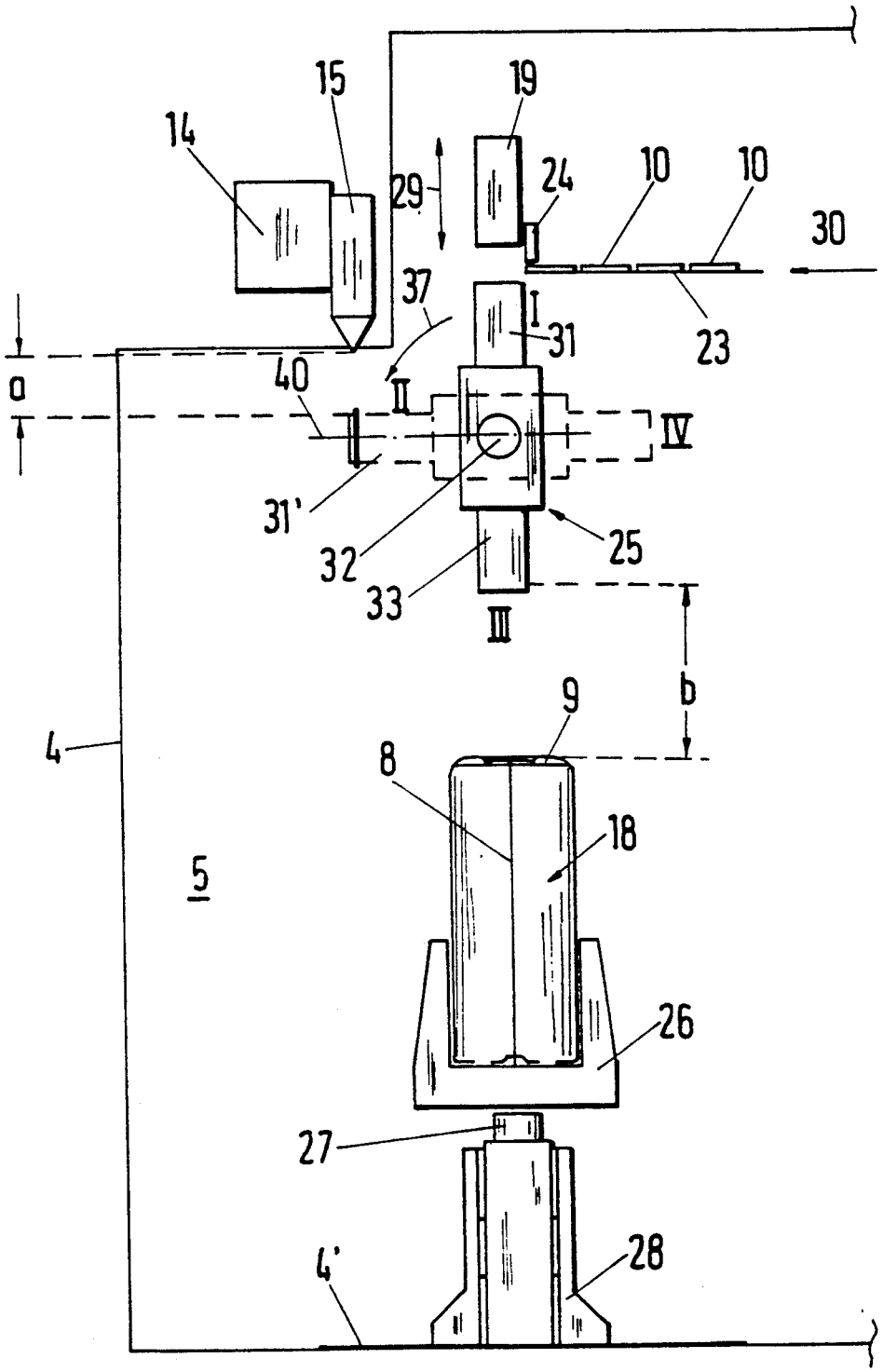

The special feature of the pouring device 10 is unimportant for the method described here and for the apparatus shown in FIGS. 1 and 2 for sealingly closing the pack 18. In particular, other forms of pouring devices can be used to perform the closure operation, as long as they just have the afore-described flange 38. To understand FIGS. 4 and 5 it should be added, however, that the bottom part 20 is provided with a pouring opening 35 which is covered over by a plastic film 51. The pouring edge 42 remains uncovered. A sealed joint between the plastic film 51 and the bottom part 20 only exists between the two parts mentioned latterly, while the closure part 21 is pressed in and can be folded up to open the pack in accordance with FIGS. 4 and 5, without the pouring opening closed in a fluid-tight manner by the plastic film 51 having to be already opened. Finally, to open the pack, the plastic film 51 must be removed.

An aseptic chamber 5, which is shown by partial shading in FIG. 1, is arranged inside the wall 4 which is broken away in the drawing. Arranged in this chamber are the main parts of the closure device for the pack 18 described here. Disposed outside this wall 4 is the adhesive device 14 with the nozzle 15. The tip 16 of the nozzle 15, with the aid of an annular sealing, not shown, being arranged in the wall 4 of the aseptic chamber 5 so that it is sealed and so that only the tip 16 of the nozzle 15 projects into the aseptic chamber 5, while the main parts of the nozzle 15, and, in particular, the adhesive device 14 are arranged outside the aseptic chamber 5.

Disposed inside the aseptic chamber 5, shown in FIG. 1, from top to bottom, are the depressing mechanism 19, a conveyor 23, a cutting device 24 possibly attached to the depressing mechanism 19, a pivot device 25 and beneath it the pack 18 arranged in the pack lifting mechanism 26.

The depressing mechanism 19 and also the rod 27 which is guided in the guide 28 can be moved vertically up and down in the direction of the double ended arrow 29, in order to separate each of the pouring devices 10 which are conveyed intermittently on the conveyor 23 from right to left in the direction of the arrow 30, in the front to the left in the region beneath the depressing mechanism 19, and in order to press them onto the vertically upstanding first mandrel 31 which is arranged at the top, and in order to then move them back up vertically in the direction of the arrow 29.

The pivot device 25 is rotatable intermittently about a horizontally disposed main axis 32, wherein at the same time the second mandrel 33 which is disposed diametrally opposite the first mandrel 31, which second mandrel is arranged so that it projects downwardly in FIG. 1, can be rotated. The mandrels 31 and 33 are cylindrical in shape. They are able to be pivoted about the axis 32, each through 90°, in the direction of rotation of the curved arrow 37, e.g. from the position shown by solid lines in FIG. 1 into the horizontal position shown by broken lines. In this horizontal position, shown by broken lines in FIG. 1, it is then possible to further rotate the first mandrel 31' which projects to the left about its longitudinal axis 40, to be more precise through 360° or through a multiple of 360°, preferably through an angle of three times 360°, whereupon rotation about this longitudinal axis 40 is interrupted.

The above-mentioned guide 28 touches the horizontal machine frame 4', and the rod 27 can be moved up and then back down in the direction of the arrow 29 with a sufficient stroke movement b, to enable the free end of the mandrel 31 or 33 can come into operative engagement with the top 9 of the pack 18.

The nozzle 15 shown in FIG. 2 can be in the form of a conventional injection nozzle, wherein, however, the operating conditions are modified so that the pressures which are conventional with injection nozzles—pressures of 60 bar, for example—are reduced to about from 5-7 bar, so that the nozzle 15 according to FIG. 2 preferably operates with a feed pressure of 5 bar.

The outer wall 41 of the nozzle which is like a cylindrical casing extends at the front in a downwardly tapering way so that it is in the form of a cone 50, in which the outlet opening 52, in the form of a cylindrical casing, is arranged.

As with conventional injection nozzles, the present nozzle 15 which has been modified has a cylindrical nozzle needle 53 centrally with a nozzle needle point 54 which is arranged at the front in the centre at the bottom. The nozzle needle 53 is likewise movable up and down vertically in the direction of the arrow 29. In FIG. 2, it is shown in the vertically upward position, and when the nozzle needle 53 is moved vertically downwardly into the extreme downward position, the cylindrical nozzle needle tip 54 is in exact alignment inside the outlet opening 52, wherein the opening 52 can be completely filled up and closed.

If the central line of the nozzle needle 53 is extended downwardly, then the double line, shown in broken lines, is to be seen which illustrates the thread of adhesive 55. Clearly, it is to be understood that the thread of adhesive 55 shown by double lines is not shown to its actual size, especially since it is completely wrapped around the partially cylindrical casing-like surface of the flange 38 of the pouring device 10 so that at least one line of thread 55 lies on the surface of the flange 38, when the pouring device 10 is rotated as described hereinabove, preferably through three times 360°, but with three threads of adhesive being disposed adjacent to, or on top of, each other. This rotation is effected about the longitudinal axis 40, shown by broken lines, wherein according to FIG. 2 the mandrel 31' is to be imagined as being arranged on the left-hand side.

In order that the thread of adhesive 55 running out of the nozzle 15 in the downward direction can actually be drawn, while the peripheral speed of the flange 38 or of the surface of the mandrel 31' is greater than the drop speed or running out speed of the thread of adhesive 55 from the outlet opening 52, and thus at the same time creating a certain rigidity, the spacing a between the nozzle tip 16 and the uppermost first point at which the thread of the adhesive 55 meets the flange 38 should not exceed a maximum length. With a preferred embodiment, this length is 25 cm for a spacing a. This is applicable to the embodiment wherein the temperature of the hot melt is approximately 170° C. The amount of hot melt between the time that the outlet opening 52 is opened for the first time and the time when it is closed subsequently is about 0.18 g.

The apparatus described in this way operates as follows:

The nozzle needle 53 is moved down from the position shown in FIG. 2, so that the nozzle needle tip 54 completely fills the outlet opening 52 and closes it. The conveyor 23 conveys a chain of joined together pouring devices 10 in the direction 30, in such a way that a pouring device 10 is pushed completely to the left beneath the cutting device 24, and is disposed above the upper face of the upwardly disposed mandrel 31. The depressing mechanism 19 then moves in the direction of the arrow 29 vertically downwards, wherein the cutting device 24 which is simultaneously activated then separates the frontmost pouring device to the left and immediately thereafter pushes it onto the first mandrel 31. The pouring device 10 is now clamped on the first mandrel 31 in such a way that it does not slip relative thereto (without forceful external effects) and moves therewith. The following stroke movement then has to take place within four seconds.

The pivot device 25 moves the first mandrel 31 by pivotal movement about the horizontal main axis 32 to the left in an anti-clockwise direction in the direction of the curved arrow 37 from position I where the mandrel is denoted by the reference numeral 31 into the horizontal position II to the left where the mandrel is denoted by the reference numeral 31'. The pivot device 25 has moved the two diametrally oppositely disposed mandrels 31, 33 in the position which is shown by broken lines, so that the first mandrel 31' is now disposed horizontally in position II with its longitudinal axis 40 extending horizontally and perpendicularly to the main axis 32. The mandrel 31' begins to rotate about that longitudinal axis 40 through an angle which is three times 360°. At the start of the rotational movement, the nozzle needle tip 54 is withdrawn from the outlet opening when the nozzle needle 53 is withdrawn and moves up in the direction of the arrow 29. The thread of adhesive 55 then emerges and meets the flange 38 of the pouring device 10 at one point. The hot adhesive is applied by the mandrel 31' or the flange 38 rotating about the longitudinal axis 40. The thread of adhesive 55 thus runs out of the outlet opening 52 under the effects, of and aided by, gravity. With the particular embodiment which is taken into consideration here, where the spacing a between the nozzle tip and the flange is at least 25 mm, the minimum peripheral speed of the flange 38 when it rotates three times is 300 mm per second. The strip of adhesive 55 is stretched thereby and it is guaranteed to be applied to the flange 38 in a straight line. The speed of issue from the nozzle 15 is therefore slower than the peripheral speed of the mandrel 31' in position II, or of the speed of the flange 38. The extent and expansion of the issuing thread of adhesive 55 ensures accurate linear application. Due to the three rotational movements made before the thread of adhesive 55 is ended by complete closure of the outlet opening 52, any abutment-, starting- or ending-regions are avoided which would deflect from one another. Instead, application is uniform and there are no regions of abutment. This is because when the thread of adhesive 55 is interrupted, or when it ends, the cylindrical nozzle needle tip 54 completely closes the outlet opening 52 and thus empties any adhesive. The residual thread is pulled back from the thread of adhesive 55 which is still running onto the flange, and is neatly wrapped around it in a straight manner. The rotational movement of the mandrel 31' relative to the movement made by the nozzle needle 53 is synchronised with precision.

In the next intermittent stage of the pivot device 25, the mandrel 31' is pivoted down into the vertical position through 90°, so that it adopts the position 33 shown in FIG. 1 by solid lines. However, the pouring device 10 still remains on the mandrel.

The rod 27 which is guided in the guide means 28 now moves, together with the pack lifting mechanism 26, in the direction of the arrow 29 upwards through the stroke movement b, so that the flange 38 of the pouring device is pressed into the collar 1 of the hole 13 in the pack 18. The upstanding collar 1 of the opening 13 makes contact with the pouring device 10 by way of the adhesive or hot melt, and becomes stuck to the pouring device. Any gaps or spaces are closed by the adhesive which is pressed in.

Since the adhesion force of the adhesive is not yet sufficient after the hot melt thread has been applied to the pouring device on the outside, when the pack 18 moves down, an auxiliary fork, not shown, assists in stripping the pouring device 10 from the mandrel 33. The pack 18 is then closed in fluid-tight manner with the pouring device 10.

While the mandrel 33 is still in the bottom position, labelled III, and is emptied by being pushed into the flange 1 of the hole 13, at the top on the oppositely disposed side, the first mandrel 31 which is now oppositely disposed in the position I is filled by the depressing mechanism 19 with the next pouring device which is pushed and clamped onto the mandrel.

The pivot device 25 then rotates the mandrel 33 from position III through 90° into position IV, where the mandrel is empty and has no function to perform. The oppositely disposed mandrel 31' is then once again disposed in position II where the same processes take place as described above. The procedure is repeated as the next gradual rotational movement takes place.

Figure 6:
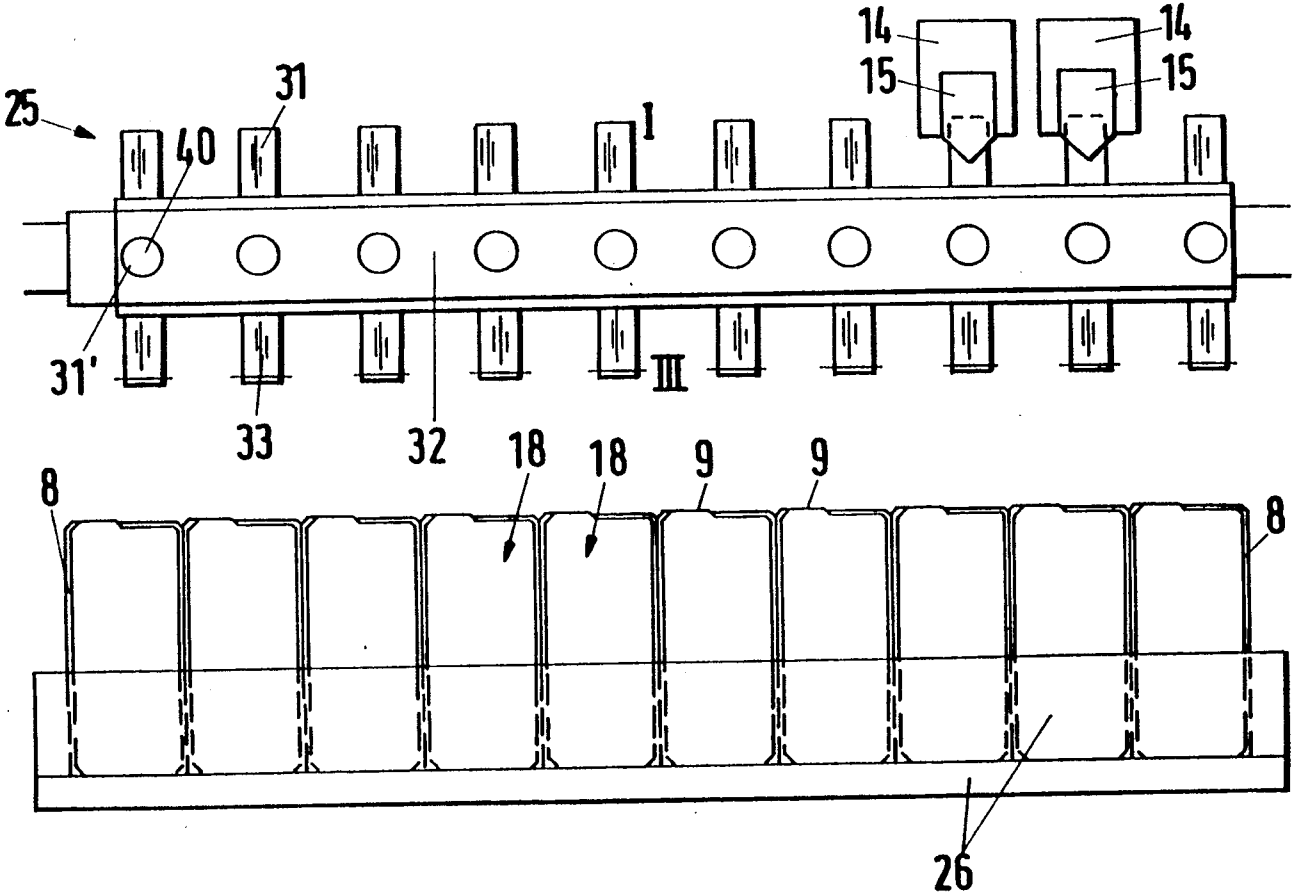

FIG. 6 illustrates another embodiment of the apparatus involving a plurality of pivoting devices 25. Each of the pivoting devices 25 is positioned above a pack 18 to which a pouring device is to be secured.

While this invention has been illustrated and described in accordance with a preferred embodiment, it is recognized that variations and changes may be made and equivalents employed herein without departing from the invention as set forth in the claims.

We claim:

1. A method for sealingly closing a pack for liquids, wherein the pack is provided with a hole having an upstanding collar, the method comprising the steps of:

positioning a pouring device on a support which has a longitudinal axis, said pouring device including a recess which defines a flange;

applying a thread of adhesive that is compatible with food to an outer peripheral surface of the flange while rotating said support about its longitudinal axis to cause the pouring device itself to rotate about a horizontal axis during application of the thread of adhesive, the longitudinal axis of the support being horizontally disposed during application of the thread of adhesive; and bringing the outer peripheral surface of the flange of the pouring device into contact with an inner surface of the upstanding collar of the pack to thereby join the flange to the collar.

2. The method according to claim 1, wherein said support and said pouring device are rotated about the longitudinal axis of the support through 1080°.

3. The method according to claim 1, wherein said thread of adhesive is applied to the flange while the pouring device and the support are rotating about a horizontally arranged axis.

4. The method according to claim 1, wherein the thread of adhesive that is applied to the flange is a hot melt adhesive.

5. The method according to claim 1, wherein the thread of adhesive is applied to the flange as an annular thread that extends around an outer circumference of the flange.

6. The method according to claim 1, wherein said step of positioning a pouring device on a support includes mounting the pouring device on one end of a rotatable mandrel at a first position, and thereafer rotating the mandrel about a horizontally disposed main axis to a second position at which the thread of adhesive is applied.

7. The method according to claim 6, wherein the main axis about which the mandrel is rotated from the first position to the second position is perpendicular to the longitudinal axis of the support.

8. The method according to claim 6, wherein said flange is brought into contact with the upstanding collar by rotating the mandrel from said second position to a third position and thereafter inserting the flange in the hole of the pack.

9. The method according to claim 1, wherein said thread of adhesive is applied to the flange by a nozzle, said thread of adhesive being applied through use of gravity.

10. The method according to claim 9, wherein said support is rotated about its longitudinal axis at a peripheral speed that is greater than a speed at which adhesive is issued from the nozzle.

11. A method for sealingly closing a pack for liquids, wherein the pack is provided with a hole having an upstanding collar, the method comprising the steps of:

positioning a pouring device on a vertically oriented mandrel which has a longitudinal axis and which is pivotable about a horizontally disposed main axis, said pouring device including a recess which defines a circular flange;

pivoting the mandrel about said horizontally disposed main axis to move the mandrel to a position in which the longitudinal axis of the mandrel is horizontally disposed;

applying a thread of adhesive that is compatible with food to an outer peripheral surface of the circular flange while rotating said mandrel about its horizontally disposed longitudinal axis to cause the pouring device itself to rotate about a horizontal axis during application of the thread of adhesive; and bringing the outer peripheral surface of the circular flange of the pouring device into contact with an inner surface of the upstanding collar of the pack to thereby join the circular flange to the collar.

12. An apparatus for sealingly closing a pack for liquids, wherein the pack is provided with a hole defined by an upstanding collar, the apparatus comprising a pivot device that includes two diametrically oppositely positioned mandrels for individually receiving a pouring device having a recess which defines a flange that is to be positioned in the hole in a pack, each of said mandrels having a longitudinal axis, said pivot device being rotatable about a main axis to move each of said mandrels from a vertical position to a horizontal position and each of said mandrels being rotatably driven about its respective longitudinal axis, and an adhesive application device having an outlet opening that is positioned above one of the mandrels when the one mandrel is located in the horizontal position to apply a thread of adhesive by way of gravity to an outer peripheral surface of the flange of a pouring device mounted on the one mandrel when the one mandrel is located in the horizontal position and while the one mandrel is being rotated about its longitudinal axis.

13. The apparatus according to claim 12, wherein the main axis is perpendicularly disposed relative to the longitudinal axis of the respective mandrels.

14. The apparatus according to claim 12, including a conveyor for conveying a strip of connected pouring devices to a depressing mechanism having a cutting device connected thereto, wherein said cutting device cuts individual pouring devices from the strip of pouring devices so that the individual pouring devices can be pressed onto an upwardly directed free end of a mandrel.

15. The apparatus according to claim 12, including a vertically movable depressing mechanism positioned above the pivot device for pressing a pouring device onto an upwardly directed free end of a vertically disposed mandrel.

16. The apparatus according to claim 15, including a cutting device attached to the depressing mechanism for cutting individual pouring devices from a strip of pouring devices so that the individual pouring devices can be pressed onto an upwardly directed free end of a vertically disposed mandrel.

17. The apparatus according to claim 12, including a pack lifting mechanism for vertically displacing a pack upwards towards a downwardly directed free end of a vertically oriented mandrel on which a pouring device is mounted.

18. The apparatus according to claim 17, wherein the pivot device, the adhesive application device and the pack lifting mechanism are disposed in an aseptic chamber.

19. The apparatus according to claim 12, wherein the adhesive application device includes a nozzle body that tapers in a narrowing manner towards the outlet opening which is downwardly directed, said nozzle body having an interior in which is disposed a vertically movable nozzle needle, said nozzle needle having a cylindrical nozzle needle point that closes the outlet opening when the nozzle needle is in a bottom-most position.

20. The apparatus according to claim 19, including a first drive control means for rotating the mandrels about their respective longitudinal axis, said first drive control means being synchronized with a second drive control means that controls vertical movement of the nozzle needle.

21. The apparatus according to claim 19, including a plurality of pivot devices and a pack lifting mechanism for holding a plurality of packs that correspond in number to the number of pivot devices, said plurality of pivot devices being rotatably driven about a common horizontal main axis, and a plurality of adhesive application devices for applying a thread of adhesive to a flange of a pouring device located on a mandrel of each pivot device.

* * * * *